US008657384B1

(12) United States Patent
Fraley et al.

(10) Patent No.: US 8,657,384 B1
(45) Date of Patent: Feb. 25, 2014

(54) TRACK SCRAPER

(75) Inventors: J. Phillip Fraley, Winfield, AL (US); John W. Davis, Winfield, AL (US)

(73) Assignee: King Kutter, Inc., Wiinfield, AL (US)

( * ) Notice: Subject to any disclaimer, the term of this patent is extended or adjusted under 35 U.S.C. 154(b) by 0 days.

(21) Appl. No.: 13/193,298

(22) Filed: Jul. 28, 2011

Related U.S. Application Data

(63) Continuation-in-part of application No. 12/466,700, filed on May 15, 2009, now abandoned.

(60) Provisional application No. 61/053,479, filed on May 15, 2008.

(51) Int. Cl.
*E21C 25/00* (2006.01)

(52) U.S. Cl.
USPC ..... 299/36.1; 172/49.5; 172/111; 172/445.1; 15/93.1

(58) Field of Classification Search
USPC ..... 172/48, 49.5, 110, 111, 684.5, 522, 172/526, 439, 445.1, 445.2, 449; 15/93.1, 15/93.3, 236.01; 451/353, 350; 125/3, 9, 125/38; 83/876, 884, 168, 300, 303, 332; 404/112, 120, 118; 299/36.1, 39.1, 299/41.1
See application file for complete search history.

(56) References Cited

U.S. PATENT DOCUMENTS

| | | | | | |
|---|---|---|---|---|---|
| 2,480,739 | A * | 8/1949 | Johnson | 15/28 |
| 2,793,476 | A * | 5/1957 | Lombardo | 451/353 |
| 3,472,555 | A * | 10/1969 | Heinrich et al. | 299/41.1 |
| 3,522,679 | A * | 8/1970 | Sundberg | 451/36 |
| 3,539,014 | A * | 11/1970 | Jonsson | 172/111 |
| 3,580,638 | A * | 5/1971 | Pullen | 299/25 |
| 4,072,196 | A * | 2/1978 | van der Lely | 172/49.5 |
| 4,295,274 | A * | 10/1981 | Bricher et al. | 30/347 |
| 4,592,108 | A * | 6/1986 | Svendsen | 15/4 |
| 4,614,380 | A * | 9/1986 | Allen | 299/41.1 |
| 4,758,050 | A * | 7/1988 | Peterson et al. | 299/41.1 |
| 4,783,875 | A * | 11/1988 | Cottam | 15/236.01 |
| 5,409,299 | A * | 4/1995 | Holder | 299/41.1 |
| 7,357,700 | B2 * | 4/2008 | Lundberg et al. | 451/353 |
| 7,690,970 | B2 * | 4/2010 | Palushaj | 451/353 |
| 2008/0176494 | A1 * | 7/2008 | Palushaj | 451/353 |

* cited by examiner

*Primary Examiner* — Matthew D Troutman
(74) *Attorney, Agent, or Firm* — Angela Holt Bradley Arant Boult Cummings LLP

(57) ABSTRACT

A track scraper for removing rubber from a racetrack is provided. The scraper comprises rotating blades that are moved along the surface of the track and that skim off portions of rubber that has been deposited on the track by race cars. The scraper is installed on and powered by a standard garden tractor.

13 Claims, 9 Drawing Sheets

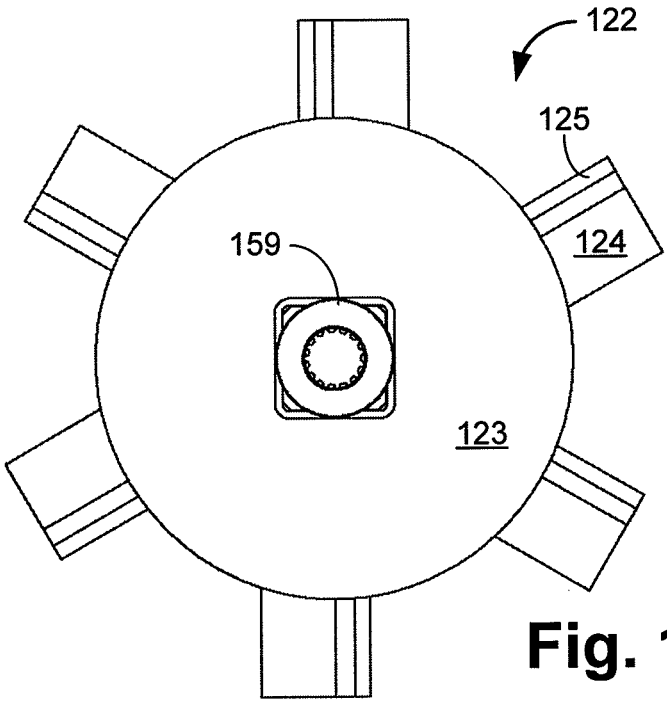
Fig. 15
Fig. 16
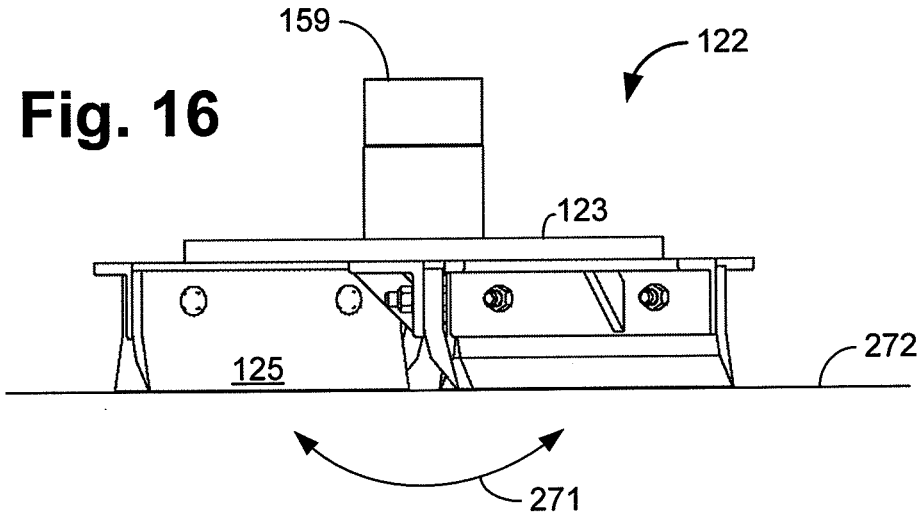

TRACK SCRAPER

CROSS REFERENCE TO RELATED APPLICATIONS

This application is a continuation-in-part of and claims priority to U.S. Non-provisional patent application Ser. No. 12/466,700, filed on May 15, 2009, the entire content of which are incorporated by reference. This application is related to U.S. Provisional Application Ser. No. 61/053,479 filed on May 15, 2008, the entire contents of which are herein incorporated by reference.

FIELD OF THE INVENTION

The present invention relates generally to the field of tractor-based, rotary-driven power equipment, and more particular relates to a device for scraping rubber from pavement.

BACKGROUND AND SUMMARY OF THE INVENTION

Tires burning out on race tracks deposit rubber on the track. Over time, the rubber may build up into a layer that affects the performance of the tires on the track.

The present invention provides a track scraper with rotating blades that scrape rubber from the surface of the track. The track scraper is installed on and powered by a standard tractor. In one embodiment, the track scraper comprises three scraping blades, each of which is rotated by a gearbox. In operation, the track scraper is lowered until its rotating blades contact the track, and then the scraper is moved along the surface of the track to remove rubber from the track. The blades are positioned for maximum coverage of the track area.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

FIG. 15 is a top plan view of the blade assembly of FIG. 14.

FIG. 16 is a front plan view of the blade assembly of FIG. 14.

DETAILED DESCRIPTION

Figure 1:
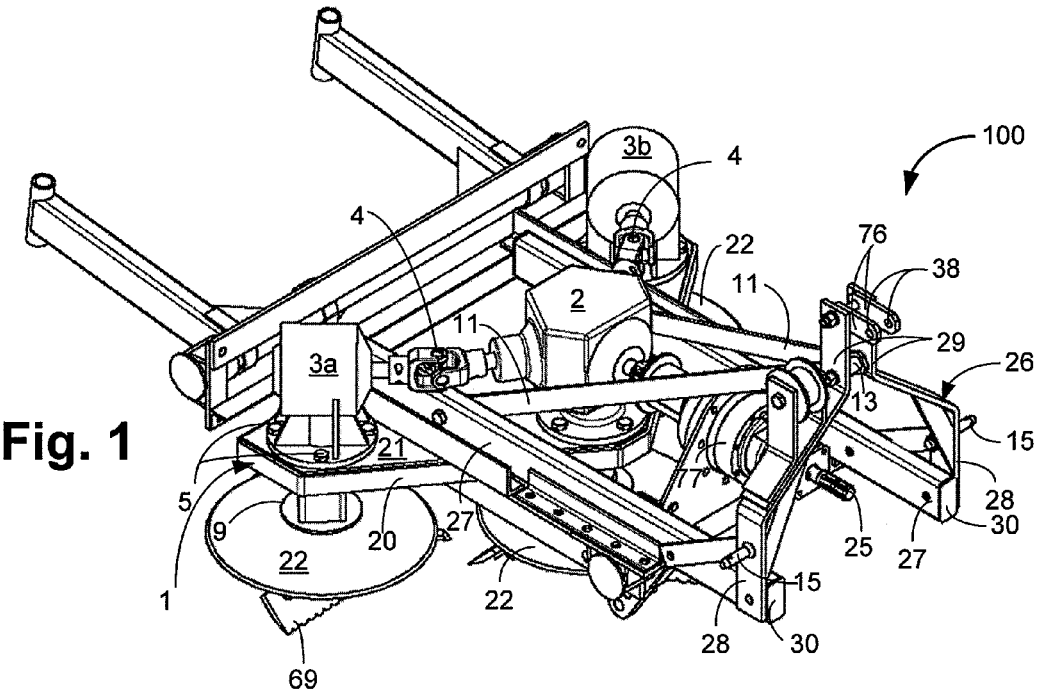
FIG. 1 is a front perspective view of an embodiment of an exemplary track scraper in accordance with the present disclosure.

FIG. 1 is a front perspective view of a track scraper 100 according to one embodiment of the present disclosure. The scraper 100 comprises three (3) rotating blade supports 22, each blade support 22 comprising a plurality of blades 69. The blades 69 contact the surface of a race track (not shown) when the track scraper 100 is in use and the blade supports 22 rotate to scrape rubber (not shown) from the track. In this embodiment, the blade supports 22 comprise slightly concave generally circular discs. Each blade support 22 rotates around a central axis (not shown), and is connected to a hub disc spring assembly 9 (only one of which is shown in FIG. 1) as shown. The hub disc spring assemblies 9 retain the blade supports 22 and connect to a divider gearbox 2 and two right angle gearboxes 3*a* and 3*b*.

The three (3) gearboxes 2, 3*a*, and 3*b* comprise gears (not shown) for turning the blade supports 22. The gearboxes 2, 3*a*, and 3*b* are bolted to a deck 21 with a plurality of bolts 5. Two yoke-cross joint assemblies 4 rotatably connect the two right angle gearboxes 3*a* and 3*b* to the divider gearbox 2. The yoke-cross joint assemblies 4 comprise any of a number of flexible mechanical connections known by persons with skill in the art to transmit rotary motion from one shaft to another.

The divider gearbox 2 is connected to a planetary gearbox 77 in the illustrated embodiment. The gearboxes 2, 3*a*, 3*b*, and 77 and the yoke-cross joint assemblies 4 are commercially-available parts.

The planetary gearbox 77 reduces the rotation of the gears (not shown) in the gearboxes 2, 3*a*, and 3*b*. For example, in one embodiment, the rotation of the blade supports 22 is desired to be generally 150 RPMs, and the commercially-available gearboxes 2, 3*a*, and 3*b* spin at generally 800 RPMs under normal operation. The planetary gearbox 77 reduces the rotation of the gears in the gearboxes 2, 3*a*, and 3*b* to 150 RPMs. In other embodiments, the planetary gearbox 77 is not used.

The planetary gearbox 77 comprises a front shaft 25 rotatably connected to a power take-off (PTO) (not shown) of a tractor (not shown). As is known by persons of skill in the art, a power take-off is a splined driveshaft on a tractor or truck that is used to provide power to an attachment or separate machines. The power take-off provides rotation to the front shaft 25 of the planetary gearbox 77, which in turn imparts rotation to the divider gearbox 2, which imparts rotation to the right angle gearboxes 3*a* and 3*b* and to the front hub disc spring assembly 8, which in turn rotates the blade supports 22.

The rotation of the blades 69 is in generally the same plane as the plane of the surface being scraped (not shown).

A deck weldment 1 comprises a frame 20 and the deck 21. The frame 20 is comprised of generally rectangular metal strips bent and/or welded into a shape resembling a triangle with cropped corners. The deck 21 is a generally thin metal plate tack-welded or otherwise securely affixed to the frame 20. The deck 21 comprises three (3) openings (not shown) for receiving the hub disc spring assemblies 9 and additional openings (not shown) to receive the plurality of bolts 5.

A lift frame 26 affixed to the deck 21 supports the scraper 100 for lifting by a tractor (not shown). In the illustrated embodiment, the lift frame 26 comprises two (2) generally horizontal supports 27 that are welded or otherwise affixed to the deck 21 and/or frame 20. The lift frame 26 further comprises two (2) front supports 28 that are affixed to the horizontal supports 27 near the front ends 30 of the horizontal supports 27. The front supports 28 extend generally upward and provide openings (not shown) for receiving lift pins 15 which are connectable to the tractor (not shown). At their upper ends 29, the front supports 28 extend inwardly toward each other, and are maintained in a fixed spaced apart position by a lift arm spacer 13. Two (2) brace arms 11 are affixed between the upper ends 29 of the front supports 28 and the rear ends of the horizontal supports 27.

The scraper 100 may be installed on a tractor (not shown) by a three point hitch (not shown) that is known in the art. The three point hitch connects to the scraper 100 via the lift pins 15, which connect to the lift arms (not shown) of the three point hitch, and via a pin (not shown) that passes through openings 38 in a swivel linkage 76 that is rotatably fastened between the upper ends 29 of the front supports 28 and connects to a top link (not shown) of the three point hitch.

The scraper 100 may also be installed on the tractor via a quick hitch (not shown) that is known in the art. The quick hitch may comprise three hooks that connect to the lift pins 15 and the lift arm spacer 13.

Figure 2:
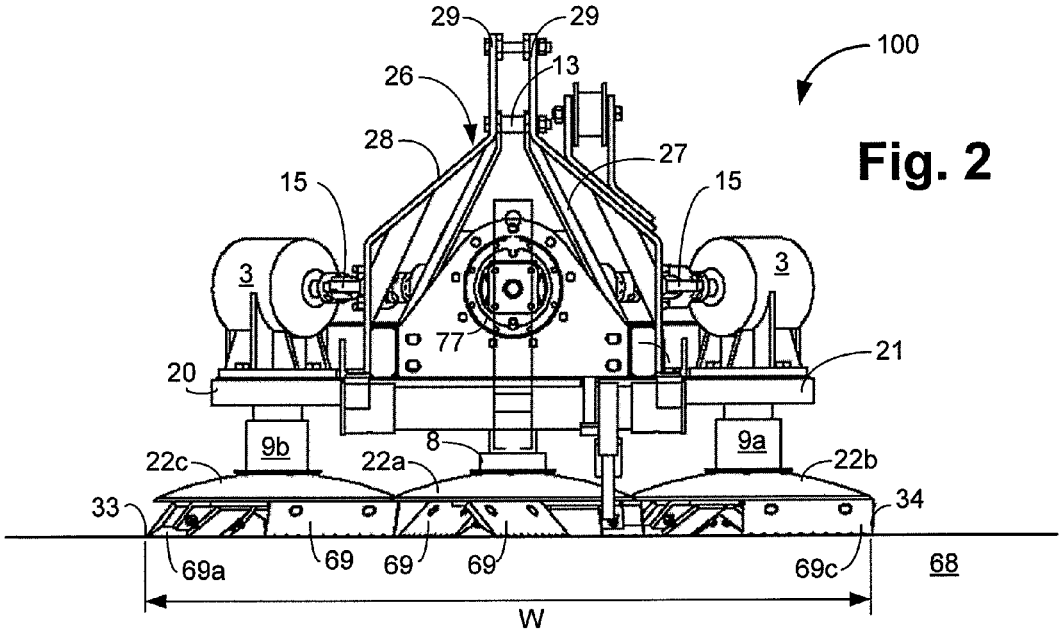
FIG. 2 is a front plan view of the exemplary track scraper illustrated in FIG. 1.

FIG. 2 is a front view of the track scraper 100 illustrated in FIG. 1. As shown in the figure, blade supports 22*a*, 22*b*, and 22*c* are positioned such that the blades 69 cover the entire width "W" of the area between the outermost edge 33 of a rightmost blade 69*a* on a right side of the track scraper 100 and the outermost edge 34 of a leftmost blade 69*b* on a left side of the track scraper 100.

Note that the blade supports 22*a*, 22*b*, and 22*c*, have convex top surfaces as illustrated. However, the blades 69 are aligned in the same plane, i.e., a generally flat plane. This is because the blades 69 are affixed to a flat plate (not shown) that is recessed within the blade supports 22*a*, 22*b*, and 22*c*. Also note that the blades 69 are designed to scrape, but not extend into, a track surface 68.

Figure 3:
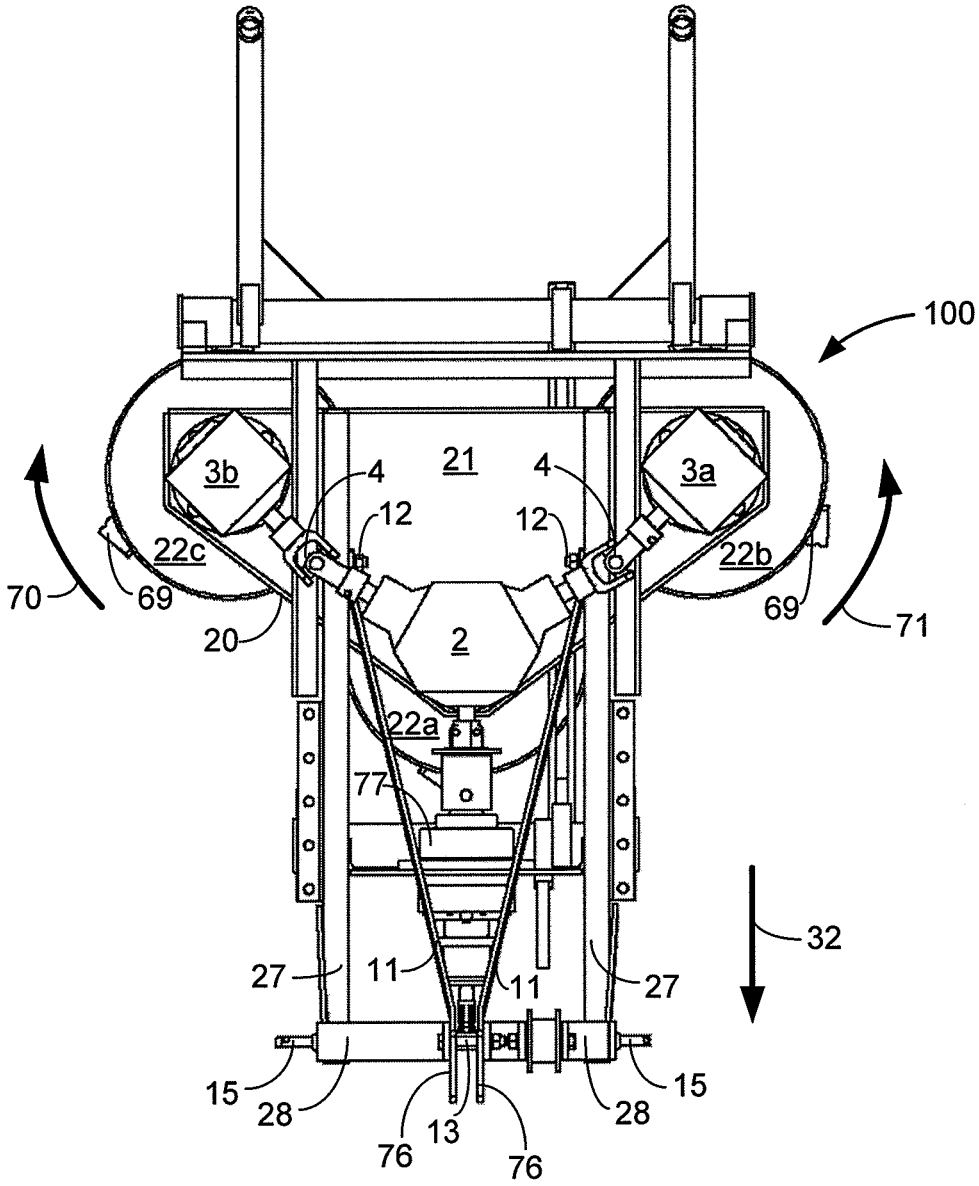
FIG. 3 is a top plan view of the exemplary track scraper illustrated in FIG. 1.

FIG. 3 is a top view of the embodiment of the track scraper 100 illustrated in FIG. 1. The deck 21 is in the general shape of a triangle with cropped corners, with the three blade supports 22*a*, 22*b*, and 22*c* each disposed each near a corner as illustrated. Blade support 22*a* is disposed near the front of the deck 21, and blade supports 22*b* and 22*c* and disposed near the left and right corners respectively. The blade supports 22*a*, 22*b*, and 22*c* are positioned for maximum coverage of track area when the scraper 100 is moved across the track in the direction shown by direction indication arrow 32.

In operation of the track scraper 100 in one embodiment, blade support 22*c* rotates clockwise, as indicated by direction arrow 70 in FIG. 2 and blade support 22*b* rotates counterclockwise, as indicated by direction arrow 71. With both blade supports 22*b* and 22*c* rotating such that their front edges move outwardly in this fashion, rubber removed from the track will be pushed out of the path of the track scraper 100. In other embodiments, all three blade supports 22*a*, 22*b*, and 22*c* may rotate in the same direction.

Figure 4:
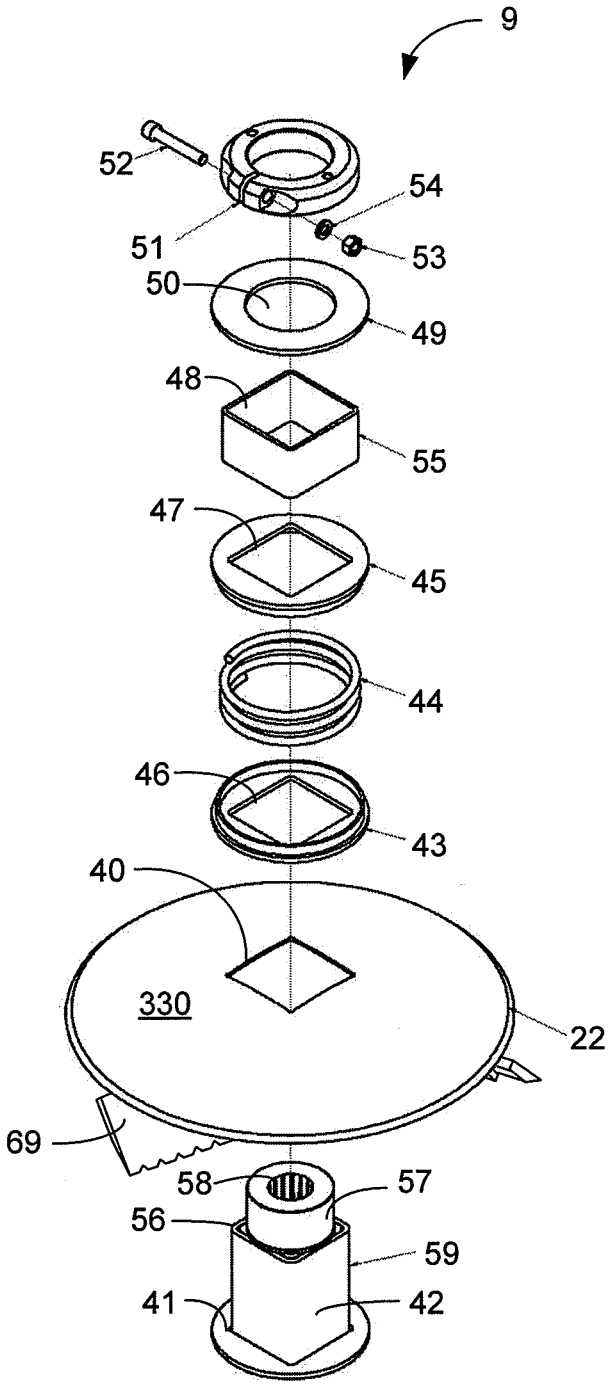
FIG. 4 is an exploded view of an exemplary hub disc spring assembly of the track scraper of FIG. 1 in accordance with the present disclosure.

FIG. 4 is an exploded view of a hub disc spring assembly 9. The hub disc spring assembly 9 comprises a drive tube assembly 59, which comprises a base 41, a main drive tube 42, and an upper shaft 57. The drive tube assembly 59 receives the blade support 22. In this regard, the blade support 22 is installed onto the drive tube assembly 59 via an opening 40 in the blade support 22 fitting over the main drive tube 42 and resting against the base 41. As illustrated, the main drive tube 42 has a generally square cross section and fits inside the similarly-shaped opening 40. Other shapes of openings/drive tubes may be used in other embodiments.

The blade support 22 is curved such that its top side 330 is convex, as was discussed above and as illustrated in FIG. 2. The opening 40 is generally square to receive the main drive tube 42. Because the top side 330 is curved and the opening 40 is generally square, the blade support 22 has some clearance such that it can "rock" or move slightly even when restrained by the hub disc spring assembly 9. This motion allowed by the blade design permits the blade supports 22 in the track scraper 100 to individually adjust such that they follow the topology of the surface (not shown) being scraped.

A lower spring cap 43 may be installed on the main drive tube 42 such that it rests against the blade support 22. The lower spring cap 43 has an opening 46 that mates with the main drive tube 42. A disc spring 44 may also be installed on the main drive tube 42, followed by an upper spring cap 45. The upper spring cap 45 has an opening 47 that mates with the main drive tube 42. The disc spring 44 may thus be "sandwiched" between the lower spring cap 43 and the upper spring cap 45. A spacer tube 55 with opening 48 is a hollow tube shaped to mate with the main drive tube 42. The spacer tube 55 is installed on top of the upper spring cap 45.

A washer 49 with opening 50 is installed on top of the spacer tube 55 and rests against an upper lip 56 of the main drive tube 42. The opening 50 of the washer 49 is sized and shaped to be received by the generally cylindrical upper shaft 57 of the main drive tube 42. A clamp 51 fits over the upper shaft 57 and is tightened by bolt 52, washer 54, and nut 53. The clamp 51 retains the components 22, 43, 44, 45, 55, and 49 onto the drive tube assembly 59.

The disc spring 44 is not utilized in some embodiments of the track scraper 100, and in those embodiments the lower spring cap 43 and the upper spring cap 45 are also not present.

Although the illustrated embodiment discloses a track scraper 100 with three (3) blade supports 22, more or fewer blade supports 22 could be employed without departing from the scope of the present disclosure.

Figure 5:
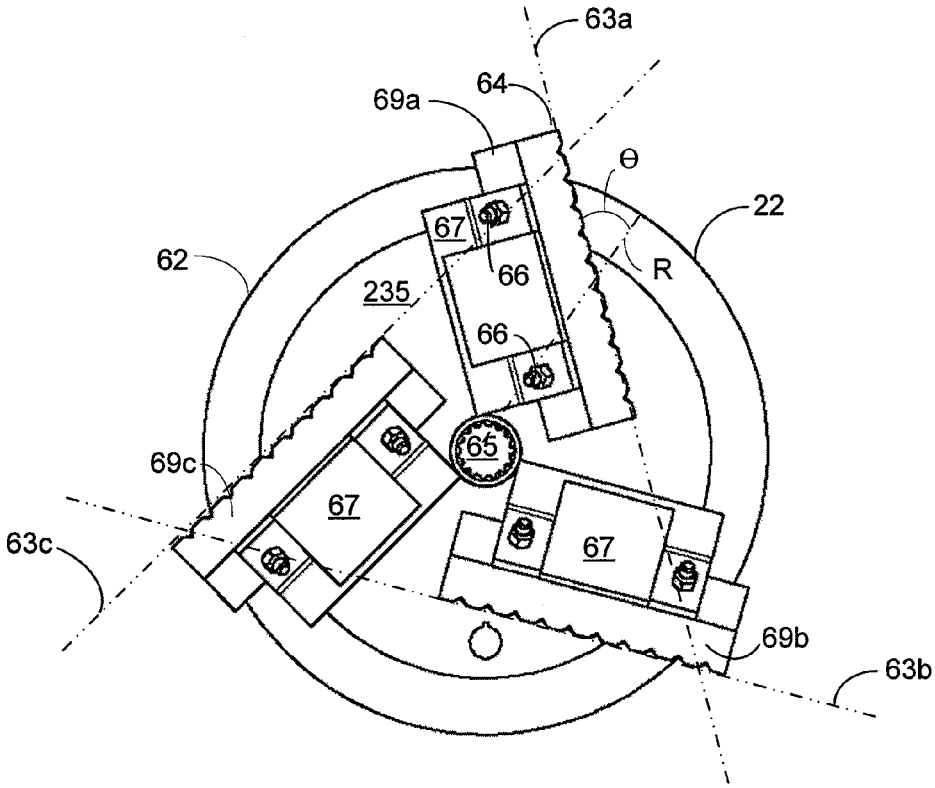
FIG. 5 is a bottom plan view of a blade support showing the plurality of scraping blades.

FIG. 5 is a bottom plan view of a blade support 22 of FIG. 1, showing three (3) substantially similar blades 69*a*, 69*b*, and 69*c*. The blades 69*a*, 69*b*, and 69*c* are each rigidly affixed via a plurality of fasteners 66 to a mounting bracket 67. The mounting brackets 67 are rigidly affixed to a backing plate 235, a generally flat plate that is rigidly affixed to the blade support, by welding in the illustrated embodiment.

The blade 69*a* comprises a scraping edge 64 that is serrated in the illustrated embodiment. The scraping edge 64 lies along a substantially straight line indicated by line 63*a*. Importantly for this embodiment, the scraping edge 64 does not lie along any plane or a line emanating radially from a center 65 of the blade support 22, e.g., the scraping edge 64 is not coextensive with a radius line indicated by "R." Rather, the scraping edge 64 is angled outwardly at an angle "θ" with respect to the radius line R. Of course, the angle between other radius lines and the scraping edge 64 would be different—and the angle will even be zero at certain radiuses around the blade support 22—but in no event would the scraping edge 64 be coextensive with a radius of the blade support 22.

The blades 69*b* and 69*c* are substantially similar to blade 69*a*. Further, the blades 69*b* and 69*c* are disposed equidistantly from each other, such that their scraping edges 64 are coextensive with the sides of an equilateral triangle. In this regard, the scraping edge 64 of blade 69*b* lies along a substantially straight line indicated by line 63*b* and the scraping edge 64 of blade 69*c* lies along a substantially straight line indicated by line 63*c*. The lines 63*a*, 63*b*, and 63*c* form an equilateral triangle in this embodiment. In other embodiments, the blades 69*a*, 69*b*, and 69*b* may be further angled outwardly such that the blades are not coextensive with the sides of an equilateral triangle. Further, in other embodiments, more than three (3) scraping blades 69 may be employed.

Figure 6:
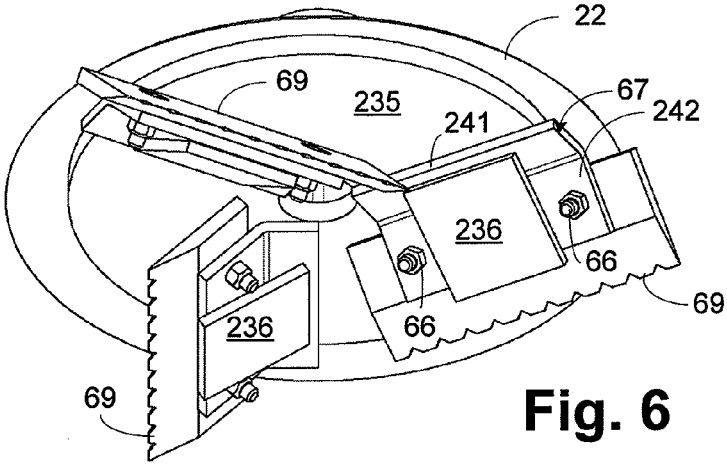
FIG. 6 is a bottom perspective view of the blade support of FIG. 5.

FIG. 6 is a bottom perspective view of the blade support 22 of FIG. 1. The mounting brackets 67 are rigidly affixed to the backing plate 235, by welding in the illustrated embodiment. The mounting bracket 67 is a generally thin angled bracket comprising a base portion 241 which is affixed to the backing plate 235. The base portion 241 is affixed to the backing plate 235 by welding in one embodiment, though may be secured by other means. The base portion 241 is generally flat, as is the surface of the backing plate 235.

The mounting bracket 67 further comprises a blade mount portion 242. The blade mount portion 242 receives the scraping blade 69 and extends downwardly from the base portion 241 at an angle "A" (FIG. 8) as further discussed herein with respect to FIG. 8. The blade mount portion 242 comprises a plurality of openings (not shown) for receiving the fasteners 66.

Figure 8:
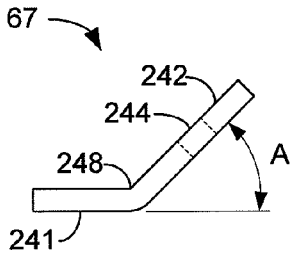
FIG. 8 is an end view of the mounting bracket of FIG. 7.

Each mounting bracket 67 further comprises a gusset 236, which is a thin flat rectangular plate welded to and extending between the base portion 241 and the blade mount portion 242 of the mounting bracket 67. The gusset 236 supports the mounting bracket 67 and helps to maintain the angle A (FIG. 8). The gusset 236 is generally affixed to the base portion 241 and the blade mount portion 242 via welding.

Figure 7:
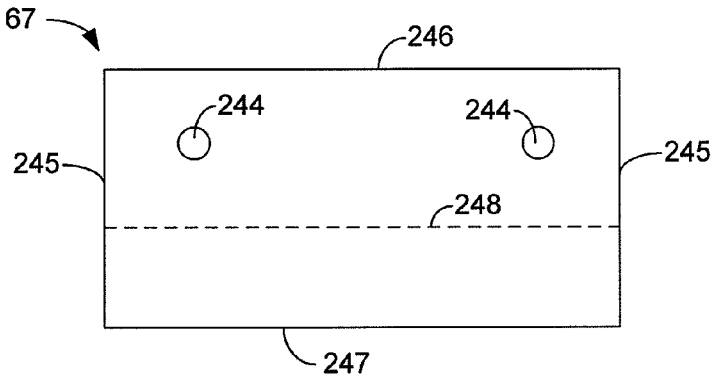
FIG. 7 is a front plan view of a mounting bracket.

FIG. 7 is a front plan view of the mounting bracket 67 of FIG. 6 before the mounting bracket 67 is bent into its final shape, as further discussed herein. The mounting bracket 67 is a generally rectangular plate comprising side edges 245, a blade mounting edge 246 adjacent to the blade 69 (FIG. 6), and a fixed edge 247 that is welded to the backing plate 235.

Openings 244 pass through the bracket 67 and receive fasteners 66 (FIG. 6) for releasably affixing the blade 69 (FIG. 6) to the bracket 37. In the illustrated embodiment, the bracket 67 comprises two (2) openings 244, but more or fewer openings 244 may be used in other embodiments. A bend line 248 defines a line generally parallel to the edges 246 and 247 about which the bracket 67 is bent, as further discussed with respect to FIG. 8.

FIG. 8 is a side plan view of the bracket 67 bent at bend line 248 into its final form. The bracket 67 comprises the base portion 241 and the blade mount portion 242. The blade mount portion 242 is disposed at an angle "A" to the base portion 241. In the illustrated embodiment, the angle A is generally 45 degrees, though may be different in other embodiment. The purpose of the angle A is to extend the blade 66 (FIG. 6) downwardly and away from the backing plate 235.

Figure 9:
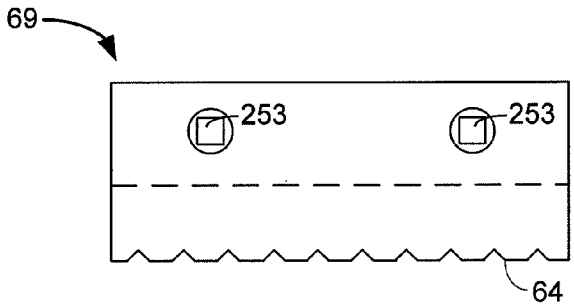
FIG. 9 is a front plan view of a scraping blade according to an embodiment of the present disclosure.

FIG. 9 is a front plan view of the blade 69 of FIG. 6. The blade 69 is fabricated from a sheet of metal, such as ½ inch thick steel, in one embodiment. The blade 69 is generally rectangular with a scraping edge 64 for scraping rubber. The blade 69 comprises openings 253 aligned with the openings 244 (FIG. 7) on the mounting bracket 67 (FIG. 7) for receiving fasteners 66 (FIG. 6) which removably affix the blade 69 to the bracket 67. The scraping edge 64 is serrated in the illustrated embodiment.

Figure 10:
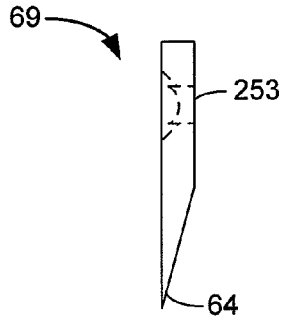
FIG. 10 is an end view of the scraping blade of FIG. 9.

FIG. 10 is an end view of the blade 69 of FIG. 9. The scraping edge 64 is tapered as shown. The openings 253 are countersunk so that the heads (not shown) of the fasteners 66 (FIG. 6) can be recessed.

Figure 11:
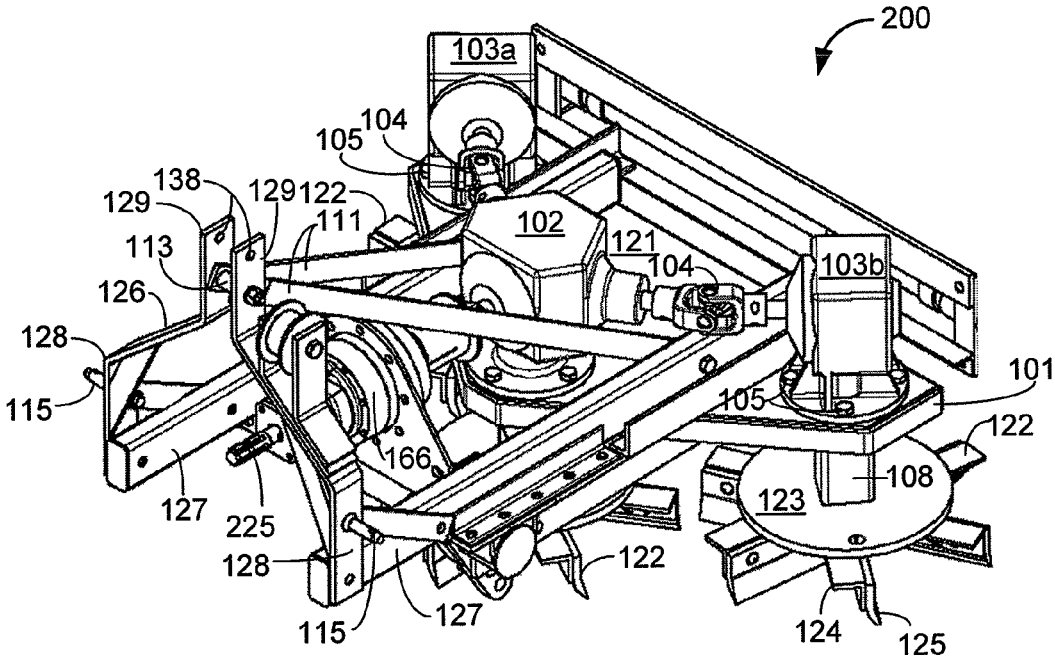
FIG. 11 is a front perspective view of an alternative embodiment of a track scraper according to the present disclosure.

FIG. 11 is a front perspective view of another track scraper 200 in accordance with an embodiment of the present disclosure. In this embodiment, the track scraper 200 comprises three rotating blade assemblies 122. The blade assemblies 122 comprise a blade support 123 (only one of which is visible in FIG. 11) to which a plurality of angle mounts 124 is affixed. The angle mounts 124 receive a plurality of scraping blades 125 which contact the surface (not shown) to scrape rubber (not shown) from the track.

Each blade assembly 122 rotates around a central axis (not shown), and is connected to a hub assembly 108 (only one of which is shown in FIG. 11) as shown. The hub assemblies 108 retain the blade assemblies 122 and connect to a divider gearbox 102 and two right angle gearboxes 103*a* and 103*b*. The hub assemblies 108 retain the blade assemblies 122 in a similar manner to that described above with respect to the hub spring disk assembly 9 of FIG. 4.

The three (3) gearboxes 102, 103*a*, and 103*b* comprise gears (not shown) for turning the blade assemblies 122. The gearboxes 102, 103*a*, and 103*b* are bolted to a deck 121 with a plurality of bolts 105. Two yoke-cross joint assemblies 104 rotatably connect the two right angle gearboxes 103*a* and 103*b* to the divider gearbox 102.

The divider gearbox 102 is connected to a planetary gearbox 166 in one embodiment. The gearboxes 102, 103*a*, 103*b*, and 166 and the yoke-cross joint assemblies 104 are commercially available parts.

A front shaft 225 extends from the planetary gearbox 166 and rotatably connects to a power take-off (PTO) (not shown) of the tractor (not shown). The tractor provides rotation to the front shaft 225, which in turn imparts rotation to the gears (not shown) in the planetary gearbox 166, which in turn rotates the gears (not shown) in the divider gearbox 102, which in turn rotates the gears (not shown) in the right angle gearboxes 103*a* and 103*b*.

The planetary gearbox 166 reduces the rotation of the gears (not shown) in the gearboxes 102, 103*a*, and 103*b*. For example, in one embodiment, the rotation of the blade assemblies 122 is desired to be generally 150 RPMs, and the commercially-available gearboxes 102, 103*a*, and 103*b* spin at generally 800 RPMs under normal operation. The planetary gearbox 166 reduces the rotation of the gears in the gearboxes 102, 103*a*, and 103*b* to 150 RPMs. In other embodiments, the planetary gearbox 166 is not used.

A deck 101 substantially similar to the deck weldment 1 discussed above with respect to FIG. 1 supports the gearboxes 102, 103*a* 103*b*, and 166.

A lift frame 126 supports the scraper 200 for lifting by a tractor (not shown). In the illustrated embodiment, the lift frame 126 comprises two (2) generally horizontal supports 127 that are welded or otherwise affixed to the deck 101. The lift frame 126 further comprises two (2) front supports 128 that are affixed to the horizontal supports 127 near the front ends of the horizontal supports 127. The front supports 128 extend generally upward and provide openings (not shown) for receiving lift pins 115 which are connectable to the tractor (not shown). At their upper ends 129, the front supports 128 extend inwardly toward each other, and are maintained in a fixed spaced apart position by a lift arm spacer 113. Two (2) brace anus 111 are affixed between the upper ends 129 of the front supports 128 and the horizontal supports 126.

The scraper 100 may be installed on a tractor (not shown) by a three point hitch (not shown) that is known in the art. The three point hitch may connect to the scraper 100 via the lift pins 115, which connect to the lift arms (not shown) of the three point hitch, and via a pin (not shown) that passes through openings 138 in the front supports 128 and connects to a top link (not shown) of the three point hitch.

The scraper 100 may also be installed on the tractor via a quick hitch (not shown) that is known in the art. The quick hitch may comprise three hooks (not shown) that connect to the lift pins 115 and the lift arm spacer 113.

Figure 12:
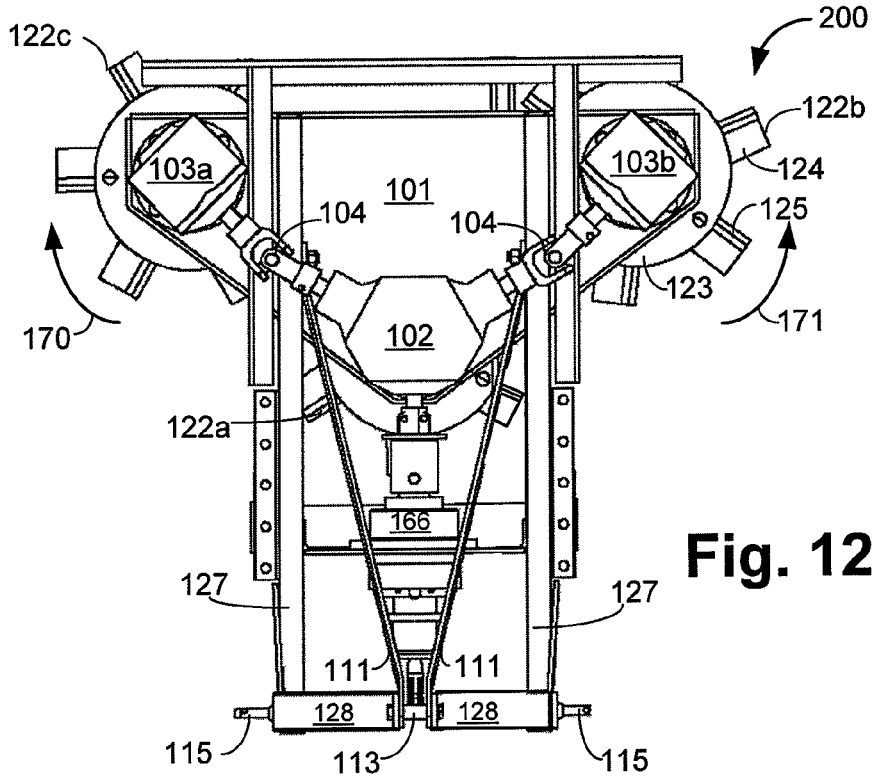
FIG. 12 is a top plan view of the track scraper of FIG. 11.

FIG. 12 is a top view of the embodiment of the track scraper 200 illustrated in FIG. 11. The deck 121 is in the general shape of a triangle with cropped corners, with the three blades 122*a*, 122*b*, and 122*c* each disposed each near a corner as illustrated. Blade 122*a* is disposed near the front of the deck 121, and blades 122*b* and 122*c* and disposed near the rear corners of the deck 121. The blades 122*a*, 122*b*, and 122*c* are positioned for maximum coverage of track area when the scraper 200 is moved across the track in the direction shown by direction indication arrow 132.

In operation of the track scraper 200 in one embodiment, blade 122*c* rotates clockwise, as indicated by direction arrow 170 in FIG. 12, and blade 122*b* rotates counterclockwise, as indicated by direction arrow 171. With both blades 122*b* and 122*c* rotating such that their front edges move outwardly in this fashion, rubber (not shown) removed from the track will be pushed out of the path of the track scraper 200. In other embodiments, all three blades 122*a*, 122*b*, and 122*c* may rotate in the same direction.

Figure 13:
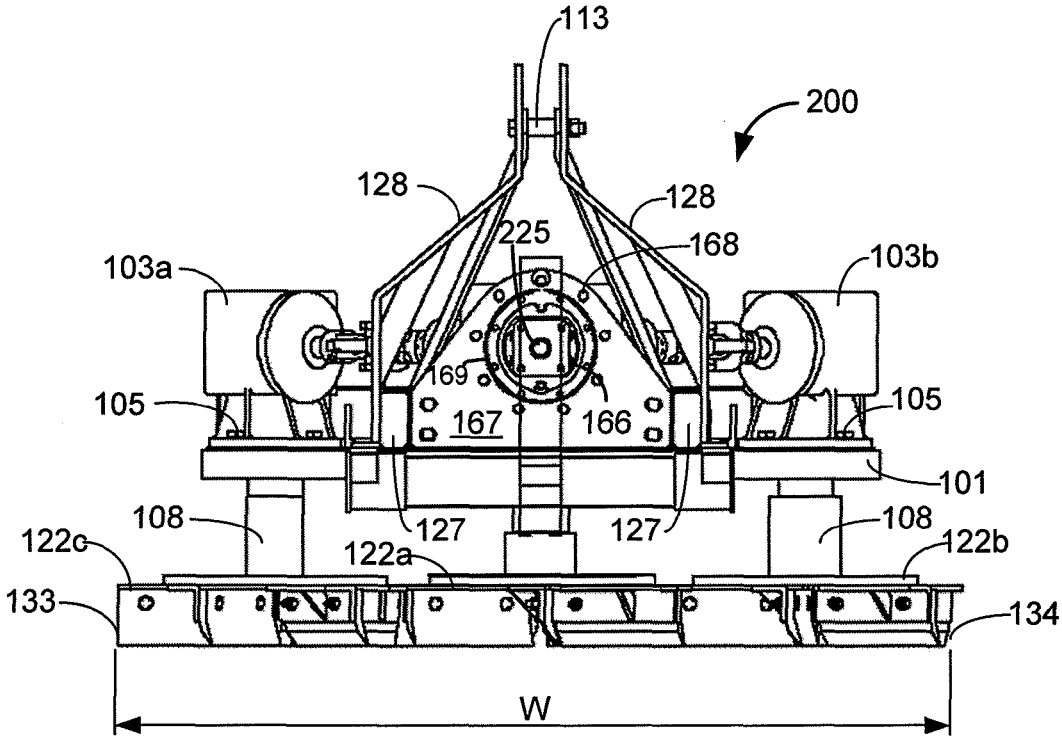
FIG. 13 is a front plan view of the track scraper of FIG. 11.

FIG. 13 is a front view of the track scraper 200 illustrated in FIG. 11. As shown in the figure, blades 122*a*, 122*b*, and 122*c* are positioned such that the blades cover the entire width "W" of the area between the outermost edge 133 of blade 122*c* and the outermost edge 134 of blade 122*b*.

The planetary gearbox 166 is supported by a front plate 167 that is affixed to the horizontal supports 127. The front plate 167 comprises a generally circular opening 169 for receiving the gearbox 166. The planetary gearbox 166 is affixed to the front plate 167 via a plurality of fasteners 168.

Figure 14:
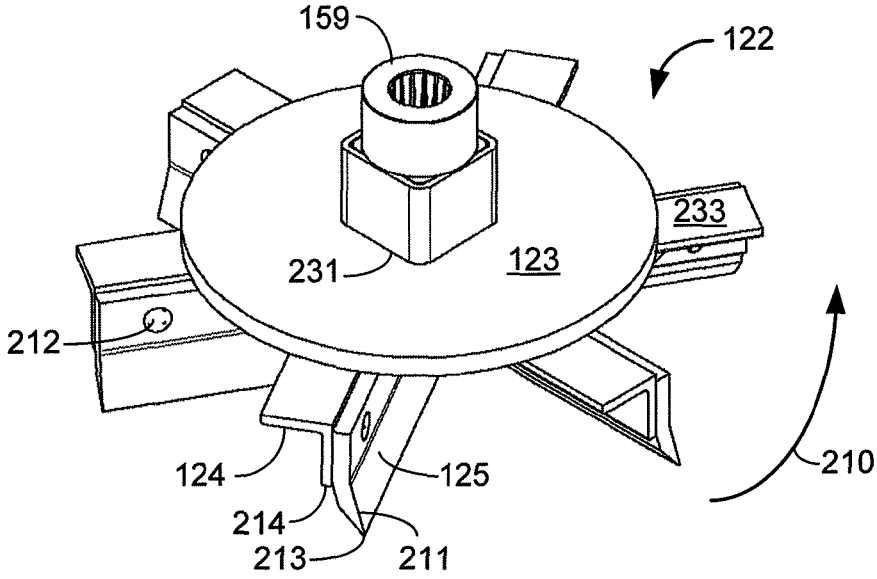
FIG. 14 is a top perspective view of an embodiment of a blade assembly used on the track scraper of FIG. 11.

FIG. 14 depicts a blade assembly 122 according to an embodiment of the present disclosure. In this embodiment, the blade assembly comprises the blade support 123 which supports the scraping blades 125 via the plurality of angle mounts 124. The blade support 123 comprises a relatively flat disk with a central opening 231 for releasably receiving a drive tube assembly 159. In one embodiment, the drive tube assembly 159 is substantially similar to the drive tube assembly 59 discussed above with respect to FIG. 4, and extends upwardly from the blade assembly 122. The blade support 123 and drive tube assembly 159 may be fabricated from any suitably strong and rigid material, such as steel.

The angle mounts 124 comprise rigid elongated L-shaped mounts that are rigidly affixed to the blade support 123. In one embodiment, the angle mounts 124 are affixed to the blade support 123 by welding a generally flat top side 233 of the angle mount 124 to the generally flat bottom side (not shown) of the blade support 123.

The scraping blades 125 extend from and are affixed to the angle mounts 124. The scraping blades 125 have an angled leading edge 211 that extends downwardly beneath a bottom edge 214 of the angle mount 124. The leading edge 211 angles toward the direction of rotation of the blade assembly 122, as indicated by directional arrow 210. The blade assembly 122 rotates in the same general plane as the plane of the track surface (not shown). The scraping blades 125 further have a tapered tip 213 that rotatably contacts the track surface when the track scraper 200 is in use. The scraping blades 125 may be fabricated by any suitably strong and rigid material, such as hardened steel.

The scraping blades 125 are affixed to the angle mounts 124 via a plurality of fasteners 212. The scraping blades 125 are removable from the angle mounts 124 by removing the fasteners 212. The scraping blades 125 are thus replaceable when they are worn.

In the illustrated embodiment, the blade assembly 122 comprises forward-facing scraping blades 125 rigidly affixed to L-shaped angle mounts 124, which angle mounts 124 are rigidly affixed to the blade support 123. In other embodiments, different configurations of blades and supports may be used for the blade assembly 122.

FIG. 15 is a top plan view of the embodiment of the blade assembly 122 of FIG. 14. The drive tube assembly 159 extends from the center of the blade support 123. The blade support 123 is generally circular in this embodiment, but may be differently shaped in other embodiments.

FIG. 16 is a side plan view of the blade assembly 122 of FIG. 14. In this embodiment, the blade support 123 is a generally flat plate, as illustrated. In other embodiments, the blade support 123 is curved in a manner similar to the blade supports 22 of FIG. 1, to allow the blade assembly to better conform to a surface 272 being scraped, as discussed above in reference to FIGS. 1 and 5. In this regard, the blade support 123 is configured so that it may tilt or rock in the direction indicated by directional arrow 271 to conform to irregular surfaces.

Figure 17:
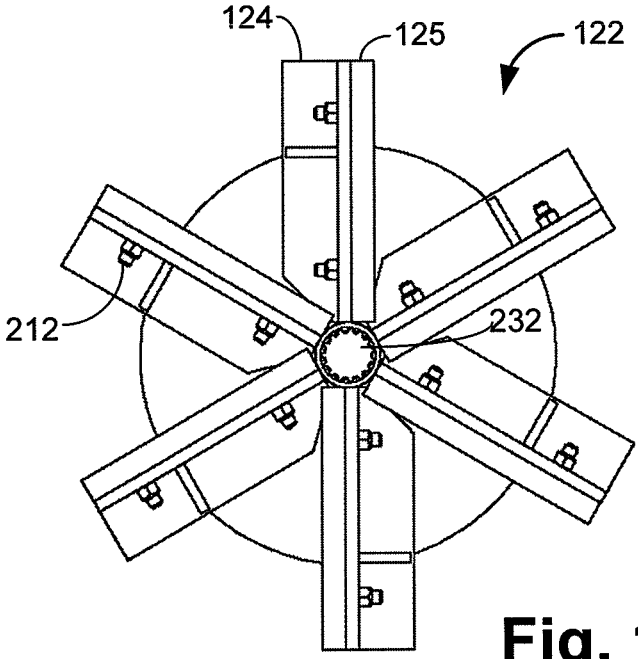
FIG. 17 is a bottom plan view of the blade assembly of FIG. 14.

FIG. 17 is a bottom plan view of an embodiment of the blade assembly 122 of FIG. 14. In this embodiment, there are six (6) angle mounts 124 with affixed scraping blades 125 extending radially and equidistantly from a central opening 232. In other embodiments, different numbers of angle mounts 124 and scraping blades 125 may be used.

Figure 18:
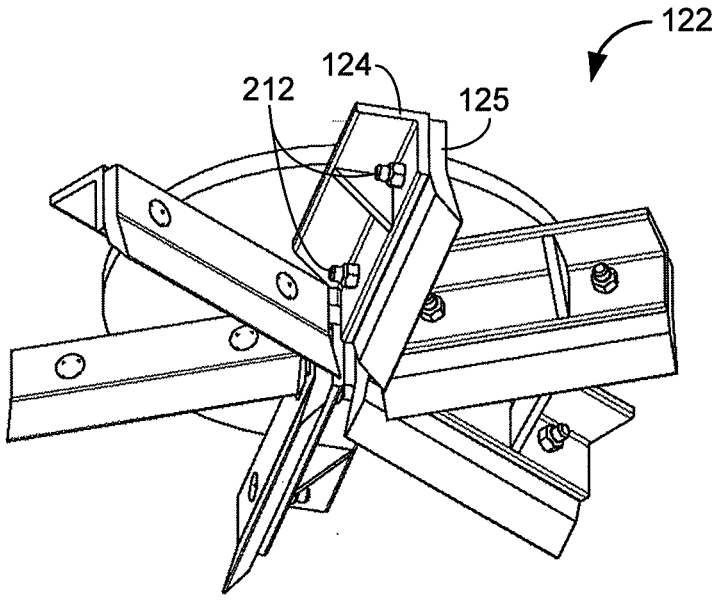
FIG. 18 is a bottom perspective view of the blade assembly of FIG. 14.

FIG. 18 is a bottom perspective view of the embodiment of the blade assembly 122 of FIG. 14. In this embodiment, each scraping blade 125 is affixed to its angle mount 124 via two standard fasteners 212 that are received by openings (not shown) on the scraping blade 125 and the angle mount 124. In other embodiments, different configurations and numbers of fasteners may be use to rigidly and removably affix the scraping blade 125 to the angle mount 124.

The invention claimed is:

1. An apparatus for scraping a surface, comprising:

a frame connectable to a three point hitch of a tractor and pullable behind the tractor;

a plurality of rotatable blade supports coupled to the frame;

a plurality of scraping blades rigidly affixed to each blade support, the plurality of scraping blades each comprising a scraping edge constructed to contact, but not extend into, the surface, the plurality of blades angled outwardly from the blade support such that the scraping edges are not aligned coextensively with a radius of the blade support, each of the scraping edges having a width that exceeds a radius of the blade support, the scraping edges each extending beyond an outer edge of the blade support;

a rotating lower shaft coupled to each blade support such that as the lower shafts rotate, the blade supports rotate thereby causing the plurality of scraping edges to scrape the surface.

2. An The apparatus of claim 1, further comprising a divider gear box coupled to the frame, the divider gearbox having a shaft constructed to rotatably connect to a power take-off of a tractor and translate motion from the power take-off to a yoke-cross joint assembly and to the lower shafts.

3. The apparatus of claim 2, further comprising a right angle gear box coupled to the yoke-cross joint assembly and the blade support, the right angle gear box translating motion in the yoke-cross joint assembly to cause the blade support to rotate.

4. The apparatus of claim 1, wherein each blade support comprises three scraping blades rigidly affixed thereto, the scraping blades angled outwardly from the blade support such that the scraping edges of the blades are coextensive with legs of an equilateral triangle.

5. An apparatus for scraping a surface, comprising:

a frame connectable to a three point hitch of a tractor and pullable behind the tractor;

a plurality of rotatable blade supports coupled to the frame;

at least three blade assemblies, the blade assemblies positioned in substantially a triangle-shaped formation, each blade assembly comprises one of the rotatable blades supports;

a plurality of scraping blades affixed to each blade assembly, wherein each of the plurality of scraping blades comprises a scraping edge constructed to contact, but not extend into, the surface, each of the scraping edges having a width that exceeds a radius of the blade support, each of the scraping edges extending beyond an outer edge of the blade support;

at least three gear boxes, one gear box for each of the three blades assemblies, constructed to receive rotary motion from a power take-off of the tractor and rotate the at least three blade assemblies thereby causing the scraping blades to scrape the surface.

6. The apparatus of claim 5, wherein one of the three gear boxes is a divider gear box that interfaces with the power take-off of the tractor.

7. The apparatus of claim 6, wherein the other two gear boxes are right angle gear boxes coupled to the divider gear box via yoke-cross joint assemblies.

8. The apparatus of claim 7, wherein when the power take-off of the tractor rotates, one blade assembly rotates via motion translated from the divider gearbox and the other two blade assemblies rotate via motion translated from the right angle gear boxes.

9. The apparatus of claim 8, wherein the at least three gear boxes are mounted to a deck.

10. The apparatus of claim 5, wherein the plurality of scraping blades are angled outwardly from the blade support such that scraping edges of the blades are not aligned coextensively with a radius of the blade support.

11. The apparatus of claim 5, wherein each blade support comprises three scraping blades rigidly affixed thereto, the scraping blades angled outwardly from the blade support such that the scraping edges of the blades are coextensive with legs of an equilateral triangle.

12. An apparatus for scraping a surface, comprising:

a frame connectable to a three point hitch of a tractor and pullable behind the tractor;

a plurality of rotatable blade supports coupled to the frame;

three scraping blades rigidly affixed to each blade support, the scraping blades each comprising a scraping edge constructed to contact, but not extend into, the surface, the scraping edges angled outwardly from the blade support such that the scraping edges are coextensive with legs of an equilateral triangle, each of the three scraping edges having a width that exceeds a radius of the blade support, each of the three scraping edges extending beyond an outer edge of the blade support;

a rotating lower shaft coupled to each blade support such that as the lower shafts rotate, the blade supports rotate thereby causing the plurality of scraping blades to scrape the surface.

13. The apparatus of claim 12, wherein the blade support is tiltable with respect to the shaft.

* * * * *